United States Patent [19]

Nakahara

[11] 4,273,529

[45] Jun. 16, 1981

[54] PIEZOELECTRIC IGNITION DEVICE

[75] Inventor: Kazumi Nakahara, Nagoya, Japan

[73] Assignee: NGK Spark Plug Co., Ltd., Nagoya, Japan

[21] Appl. No.: 42,135

[22] Filed: May 24, 1979

[30] Foreign Application Priority Data

May 30, 1978 [JP] Japan ..... 53/72980[U]

[51] Int. Cl.[3] ..... F23Q 3/00

[52] U.S. Cl. ..... 431/255; 361/260; 431/47

[58] Field of Search ..... 431/254, 255, 256, 257, 431/47; 126/39 E; 361/260

[56] References Cited

U.S. PATENT DOCUMENTS

| | | | |
|---|---|---|---|
| 3,428,408 | 2/1969 | Amegama | 431/255 |
| 3,434,790 | 3/1969 | Kanda | 431/255 |
| 3,676,047 | 7/1972 | Soma | 431/255 |
| 4,110,065 | 8/1978 | Fujiwara | 431/255 |

FOREIGN PATENT DOCUMENTS

| | | | |
|---|---|---|---|
| 2330960 | 4/1975 | France | 431/255 |

*Primary Examiner*—George E. Lowrance
*Attorney, Agent, or Firm*—Thomas R. Morrison

[57] ABSTRACT

A piezoelectric ignition device of the type having a base mount formed with a window in which a piezoelectric element is fixedly mounted and a cylindrical hammer is axially movable and urged by a coiled spring toward the piezoelectric element. The entire assembly is adapted to be readily mounted in an automatic ignition to gas range etc. of a type having axle fixed with knob for operating gas valve. The base mount has a hole for snugly receiving said axle. An arm member is mounted with a key on the axle in such a way that when the knob is manually actuated for opening the gas valve, the arm rotates to move the hammer to a retracted position against the force of the spring and then disengages it for a rapid return for ignition. When actuating the knob for closing valve, the arm slides around circumferential surface of a cylinder against another spring so as to clear the cylinder and to return to its initial position.

7 Claims, 8 Drawing Figures

PIEZOELECTRIC IGNITION DEVICE

Figure 1:
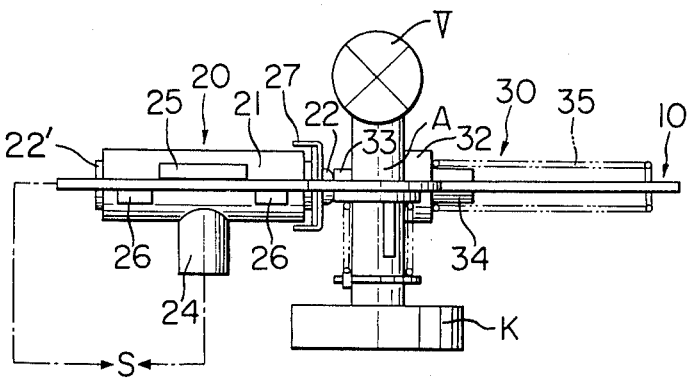

The present invention relates generally to a piezoelectric ignition device adapted to be automatically operated when manually opening a gas cock for instance of a gas range, and more particularly to such device which is provided with a hammer urged by a spring means to normally rest at one end thereof on the end of a cylindrical piezoelectric element and with a member mechanically related to the gas cock in such a way that when manually rotating said cock said member forcingly moves said hammer for a predetermined distance against said spring means and suddenly releases said hammer for hammering said piezoelectric element.

The ignition device having an elongated rectangular sheet metal formed with an elongated open window for mounting the cylindrical piezoelectric element to be fixed and the hammer to be axially movable has been proposed. The invention relates to a simple and reliable mechanism from another view point for realizing said automatic operation of such ignition device readily applicable to the gas cock of the type having an axle adapted to be rotated by a knob fixed at one end thereof so that when manually actuating said knob to be angularly moved the other end of said axle may open or close the valve means.

The mechanism according to the invention fundamentally comprises an arm member which is mounted on said gas cock axle for angular movement together therewith and provided with an actuation arm so extending that the free end thereof normally abuts on the forward end of the cylindrical hammer in its normal position and when manually actuating said gas cock knob for opening the gas valve said arm free end may angularly move to bring the cylindrical hammer a predetermined distance to the retracted position against the force of said spring means and then to disengage said hammer to permit it to return to the normal position for striking the piezoelectric element.

The actuation knob having angularly moved by an angle corresponding to said predetermined distance of the hammer axial movement, is left at the position in its rotated position after the cylindrical hammer has been returned to the normal position. Thus, when the knob of the gas cock is actuated for closing the gas valve the arm cannot clear the cylindrical hammer to return to the initial position. In order to make it possible for said arm member to clear the hammer and return to the initial position, the mechanism according to the invention comprises further a spring means adapted to normally urge the arm member to be able to angularly move as referred to above but which will also allow the arm member to move a small amount against the force of said spring means in the axial direction regarding said gas cock axle and consequently in the radial direction regarding said cylindrical hammer. It is preferable in order to allow said clearance movement of the arm member to form a hole so that said arm member is loosely mounted on the gas cock axle and fixed therewith by a key for integral angular movement.

Figure 2:
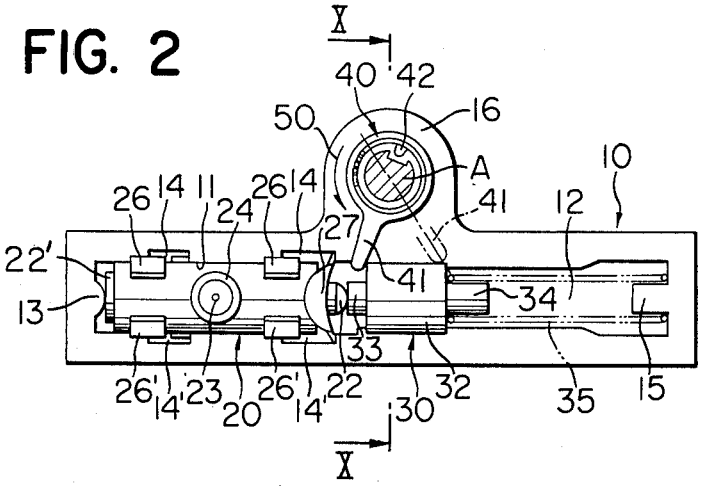
Figure 3:
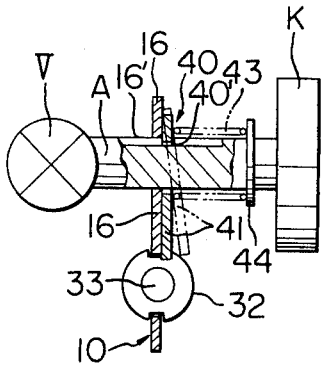
Figure 5:
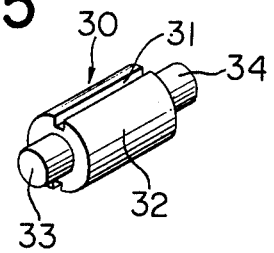
Figure 4:
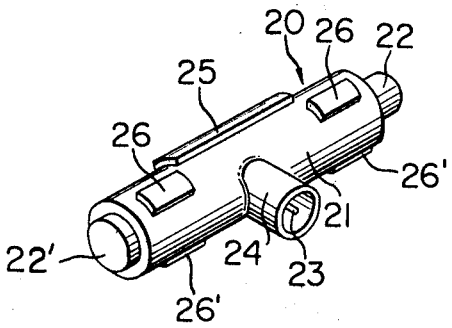
Figure 6:
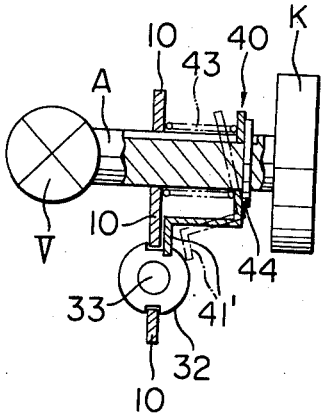
Figure 7:
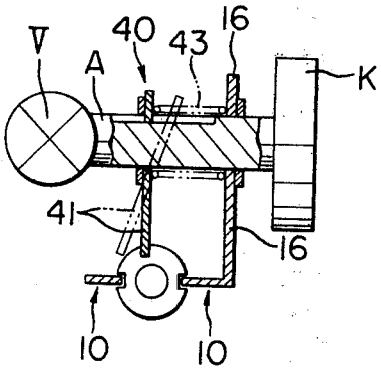
Figure 8:
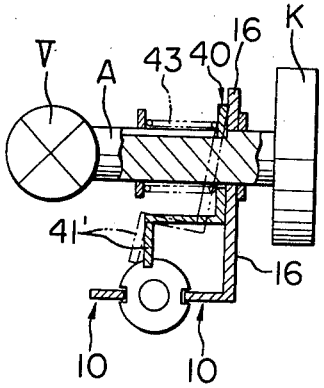

Some preferred embodiments of the invention shall be explained in reference to the accompanying drawing, in which;

FIG. 1 is a plan view of the first embodiment of the invention mounted to the gas cock, FIG. 2 is a front view of the ignition device, FIG. 3 is a cross section of the mechanism taken along line X, X in FIG. 2, FIG. 4 is a perspective view of a cylindrical piezoelectric element which itself is not the subject of the invention, FIG. 5 is a perspective view of a cylindrical hammer which itself is not the subject of the invention, FIG. 6 is a cross section similar to FIG. 3 but showing a second embodiment of the invention, FIG. 7 is a cross section similar to FIG. 3 showing a third embodiment of the invention, and FIG. 8 is a cross section similar to FIG. 3 showing a fourth embodiment of the invention.

In FIGS. 1 and 2, a base mount, shown generally at 10, is prepared by press punching from sheet metal. The substantially rectangular elongated base mount 10 has an elongated open window 11 and 12 which consists of a first window portion 11 for fixedly mounting a cylindrical piezoelectric element 20 and a second window portion 12 for mounting a cylindrical hammer 30 for axial movement therein.

The width of the opening of first window portion 11 is only a little larger than the diameter of the piezoelectric element 20 for snugly receiving it. At the end of first window portion 11, an inward projection 13 is preferably formed for stably holding the element 20. For the purpose to be explained later, two pairs of notches 14, 14; 14', 14' are formed at opposite side edges of window 11.

As best shown in FIG. 4, piezoelectric element 20 has a cylindrical sleeve 21 of any insulation material and end discs 22, 22'. An electric output terminal 23 is covered by an insulating cover 24. Axially extended protrusion 25 and two axially extended protrusions 26, 26 are provided on the circumferential surface of sleeve 21 so as to provide an axially extending gap therebetween for receiving the side edge of window portion 11. Similar protrusion 25' and two protrusions 26', 26' are provided so as to receive the opposite side edge of the window 11 therebetween. In order to mount piezoelectric element 20 in window 11, the former is positioned in relation to the mount base 10 such that axial protrusions 26, 26' clear notches 24, 24' and then is axially moved so that the end disc 22' abuts inward projection 13. At this position of piezoelectric element 20, a washer 27 is fitted over end disc 22 for fixing element 20 in position in base mount 10.

The width of second window portion 12 is a little smaller than the diameter of cylindrical hammer 30 so that cylindrical hammer 30 is axially moveable along window 12 by engagement of the opposite side edges of second window portion 12 by a pair of axially extending slits 31 formed in a circumferential surface 32 of cylindrical hammer 30, as best shown in FIG. 5. Hammer 30 has a forward reduced diameter end 33 for striking end disc 22 of piezoelectric element 20 and a rearward reduced diameter end 34 for receiving one end of a coiled spring 35 as best shown in FIG. 2. The other end of coiled spring 35 is received by an inward projection 15 formed at the end of second window portion 12 so as to urge cylindrical hammer 30 in the forward direction toward forward reduced diameter end 33 thereof to normally abut it against end disc 22 of piezoelectric element 20. In order to amount hammer 30 in window 12, hammer 3, which has a diameter that is smaller than the width of first window portion 11 but larger than second window portion 12, is positioned in first window portion 11 before mounting piezoelectric element 20 therein and is then axially moved into position in second window 12 against the force of coiled spring 35.

The construction described above is conventional and is not the subject matter of the present invention. A feature of the present invention is explained with reference also to FIG. 3. As best shown in FIG. 2, base mount 10 has a transversely projecting portion 16 having a hole 16' for snugly receiving an axle A of a gas cock valve V having a knob K fixed at one end thereof for integrally angular movement so as to open and close valve V arranged at the opposite end. It will be readily appreciated that the assembled ignition device as explained above can be easily mounted on axle A, for instance by removing knob K in the already designed or manufactured gas range, as best shown in FIG. 3. Of course it is necessary to combine the mechanism to be explained hereafter with said assembly before mounting it to the gas rage.

An actuation arm member represented generally by 40 is formed with a hole 40' at a disc portion thereof for loosely receiving axle A and has an arm member 41 projecting from said disc portion. Arm member 41 is fixed to axle A by a key 42 so as to angularly move together with axle A and consequently with knob K in a plane parallel to base mount 10 between a normal rest position shown by a solid line and a hammer release position shown by a phantom line respectively in FIG. 2. The looseness of the fit of hole 40' on axle A allows slight angular movement of actuation arm member 40 in a plane normal to its first plane between its normal position shown by a solid line and its hammer clearing position shown by a phantom line respectively in FIG. 3.

In order to keep arm member 40 in its normal stance and to allow it to assume its hammer clearing stance, a coiled spring 43 is loaded around axle A between arm member 40 and a disc 44 fixed to axle A.

In operation, when knob K is manually rotated for opening gas valve V, axle A and actuation arm member 40 are rotated in the counterclockwise direction shown by an arrow 50 in FIG. 2 until the free end of arm 41 in engagement with hammer 30 reaches the phantom line position in said figure. Upon slight additional rotation of actuation arm member 40, hammer 30 is released by actuation arm member 41 to suddenly permit it to return to its initial position under the urging of said coiled spring 35. Forward reduced diameter end 33 forcibly strikes end disc 22 and generates a spark across a spark gap S in FIG. 1 to ignite gas around spark gap S released by actuation of valve V.

When it is desired to extinguish the gas fire, knob K and arm 41 are rotated in the clockwise direction in FIG. 2 to return them to the initial solid line position. If the stance of arm member 40 were kept as shown by the solid line in FIG. 3, the tip of arm member 41 would be unable to clear hammer 30. Owing to the loose mounting of actuation arm member 40 on axle A and the presence of coiled spring 43, the force applied to arm member 41 for rotation in the clockwise direction in FIG. 2 acts to force the tip of arm member 41 to slide along the circumferential surface of the hammer so as to follow the phantom line stance in FIG. 3 where it can be returned in its initial position shown by the solid line in FIG. 2.

Referring now to FIG. 6, there is shown a second embodiment of the invention. This differs from the embodiment of FIGS. 1–5 in that a disc portion of arm member 40 is not in the same plane as arm portion 41', but is offset by double bends in an intermediate portion to take on the form of a crankshaft. Thus, arm portion 41' is close to base mount 10 but the disc portion is spaced apart therefrom so that coiled spring 43 is loaded not between actuation arm member 40 and disc 44 but between the disc portion of actuation arm member 40 and base mount 10 as shown in FIG. 6. The operation of the embodiment of FIG. 6 is the same as previously described and will therefore be omitted here.

Referring now to FIGS. 7 and 8, third and fourth embodiments are shown. These embodiments differ from the above described embodiments in that transversely projecting portion 16, where gas cock axle A extends therethrough, and the members for realizing automatic operation of the ignition device in response to manual actuation of gas cock knob K are mounted, not in the same plane as other portions of base mount 10 but are disposed in a plane which is at right angles thereto. In FIG. 7, arm member 40 itself is the same as in FIG. 3. In FIG. 8 the arm member 40 is the same as in FIG. 6. The operation of these embodiments is the same as previously described and will be omitted here.

What is claimed is:

1. A piezoelectric ignition device comprising:

a base mount having an elongated window with first and second contiguous window portions, a cylindrical piezoelectric element fixedly held in said first window portion, a cylindrical hammer slideably held in said second window portion for axial movement between a normal position wherein one end of said hammer rests on an end of said piezoelectric element and a retracted position, spring means for urging said hammer toward said normal position and for rapidly returning said hammer into said normal position after been brought into said retracted position, whereby an ignition spark is generated, said ignition device being operable with a gas equipment having a gas valve actuated by an axle connected thereto, wherein manual rotation of said axle opens or closes said valve depending on the direction of said rotation, a hole formed in said base mount for snugly rotatably receiving said axle, an actuation arm member having a hole therein for loosely receiving said axle, means for producing unitary rotation of said actuation arm member with said axle, said rotation being in a plane generally parallel to an axis of said cylindrical hammer, an actuation arm on said actuation arm member having a free end normally abutting a forward end of said cylindrical hammer when said cylindrical hammer is in said normal position when said axle is in a position which closes said gas valve, said arm free end being operative to move said hammer into said retracted position against the force of said spring means when said axle is rotated in a direction which opens said gas valve and being further operative to disengage said hammer for permitting said hammer to rapidly return to said normal rest position, and another spring means operative to urge said actuation arm member into a normal stance while said arm member is rotated toward said retracted position and further operative to permit said actuation arm member to tilt on said axle whereby said arm free end may slide along the circumferential surface of said cylindrical hammer against the force of said another spring means to allow said actuation arm member to return to said normal position.

2. The piezoelectric ignition device as claimed in claim 1 in which said base mount comprises sheet metal having said first and second contiguous window portions punched therein, a transversely projecting portion containing said hole and said means for producing unitary rotation being a key.

3. The piezoelectric ignition device as claimed in claim 2 in which said actuation arm member includes a disc portion wherein said hole is formed, said actuation arm being integrally connected to said disc portion and said disc portion and said actuation arm being in the same plane.

4. The piezoelectric ignition device as claimed in claim 2 in which actuation arm member includes a disc portion wherein said hole is formed, said actuation arm being integrally connected to said disc portion by an intermediate portion which is bent 90° in opposite directions at boundaries of said intermediate portion with said disc portion and said actuation arm respectively so that said disc portion and said actuation arm are parallel and extend in opposite directions.

5. The piezoelectric ignition device, as claimed in claim 2, in which said transversely projecting portion of said base mount is bent 90° relative to a plane of said base mount.

6. The piezoelectric ignition device as claimed in claim 5, in which said actuation arm member includes a disc portion wherein said hole is formed, said actuation arm being integrally connected to said disc portion, and said disc portion and said actuation arm being in the same plane.

7. The piezoelectric ignition device as claimed in claim 5, in which said actuation arm member includes a disc portion wherein said hole is formed, said actuation arm being connected to said disc portion by an intermediate portion, which is bent 90° in opposite directions at boundaries of said intermediate portion with said disc portion and said actuation arm respectively so that said disc portion and said actuation arm are parallel and extend in opposite directions.

* * * * *